US005542502A

United States Patent [19]

Scriven

[11] Patent Number: 5,542,502

[45] Date of Patent: Aug. 6, 1996

[54] HOIST DRIVEN RESCUE MAT FOR SWIMMING POOL

[76] Inventor: Reginald K. Scriven, 7122 Canary Dr., Fayetteville, N.C. 28314

[21] Appl. No.: 432,681

[22] Filed: May 2, 1995

[51] Int. Cl.[6] ..... B66B 7/00

[52] U.S. Cl. ..... 187/414; 52/169.7

[58] Field of Search ..... 187/414, 270, 187/205; 52/169.7

[56] References Cited

U.S. PATENT DOCUMENTS 4,937,896 7/1990 Niimura ..... 52/169.7

5,271,483 12/1993 Hong ..... 52/169.7

*Primary Examiner*—Kenneth Noland

[57] ABSTRACT

A rescue mat for use in an in-ground swimming pool includes a horizontally disposed mat extending across at the corners of the deepest end of the swimming pool to the start of the shallow end, attachable at the corners of the mat. The mat being connected to the wall surface of the swimming pool by a plurality of hook connectors are attached to a plurality of wheels in tracks disposed at the corners and start of shallower end of swimming pool so that when rescue mat is activated a person may be lifted safely from the bottom of the pool. Lifting is achieved by surface mounted hoists connected to wheels by a plurality of cables.

3 Claims, 2 Drawing Sheets

HOIST DRIVEN RESCUE MAT FOR SWIMMING POOL

BACKGROUND-FIELD OF INVENTION

The present invention relates to aquatic rescue devices.

OBJECTS AND ADVANTAGES

The present invention intends to be used as a means of rescuing potential drowning victims from a swimming pool without having to enter the pool itself. It is also purposed to have two simultaneously operating hoists to lift drowning victim smoothly and quickly from the water. The present invention also intends to provide several varied embodiments of which only one is described below. One embodiment includes manufacturing the present invention so that it may be adaptable to preexisting swimming pools.

The advantages of the present invention are that it does not endanger the lives of the persons intending to rescue the drowning victim and provides a quicker method of retrieving persons from the water.

Accordingly, the present invention provides:

(a) a safe means of rescuing potential drowning victims from swimming pools;

(b) a lifting means of rescuing potential drowning victims;

(c) a simple and fast system lifting potential drowning victims from swimming pools.

Further objects and advantages will become apparent from a consideration of the following description and drawings.

DRAWING FIGURES

Although the characteristic features of the present invention will be particularly pointed out in the claims, the invention itself, and the manner in which it may be made and used, may be better understood by referring to the following description taken in connection with the accompanying drawings forming a part hereof, wherein like reference numerals refer to like parts throughout the several views and in which:

Reference Numerals in Drawings

| | |
|---|---|
| 41 pool wall | 43 water surface |
| 45 pool bottom | 47 ground level |
| 49 pool surface | 51 hoist housing |
| 53 rescue mat | 55 wheel track |
| 57 track wall (interior) | 59 cable |
| 61 cable conduit | 63 wheel |
| 65 guide | 67 hook |
| 69 border | 71 stationary wheel |
| 73 rotating wheel | 75 loop |
| 77 netted interior | |

DESCRIPTION

While the present invention will be described fully hereinafter with reference to the accompanying drawings, in which a particular embodiment is shown, it is to be understood at the outset that persons skilled in the art may modify the invention herein described while still achieving the described results of this invention. Accordingly, the description which follows is to be understood as a broad informative disclosure directed to persons of skill in the appropriate arts and not as limitation upon the present invention.

Figure 1:
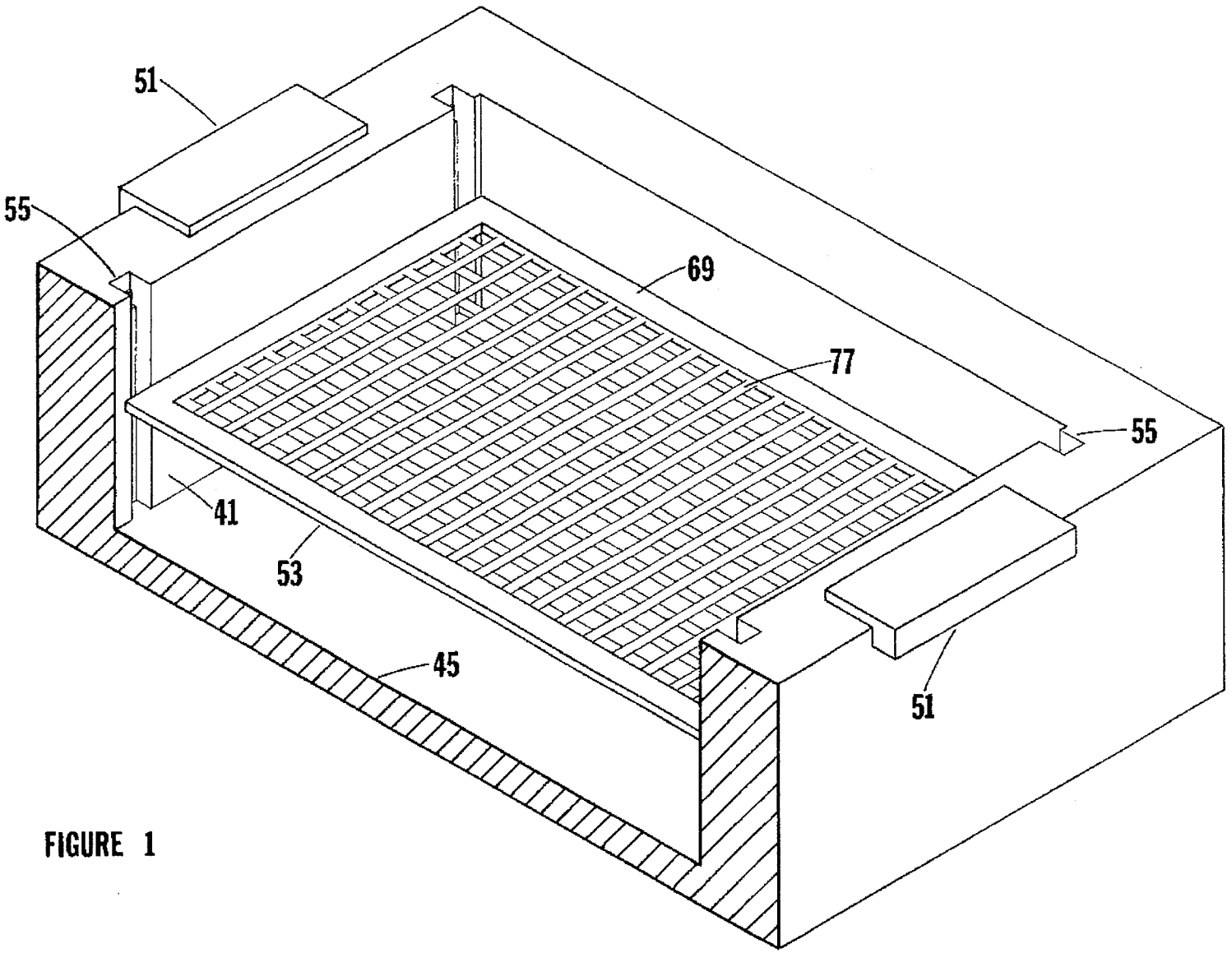
FIG. 1 shows a full perspective of one embodiment of the present invention.

A rescue mat made in accordance with the concepts of the present invention is generally indicated by the numeral 53 and shown in FIG. 1 as being attached to an in-ground swimming pool.

Figure 3:
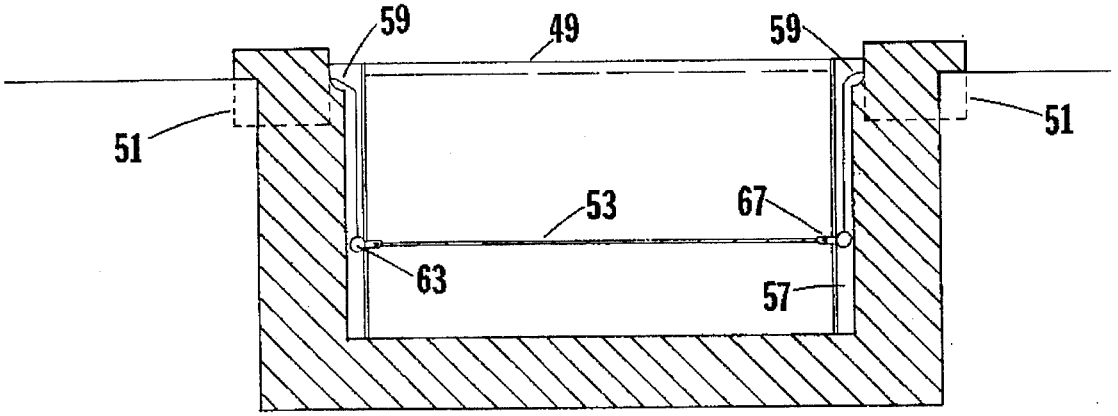
FIG. 3 shows a side section of the present invention.
Figure 4:
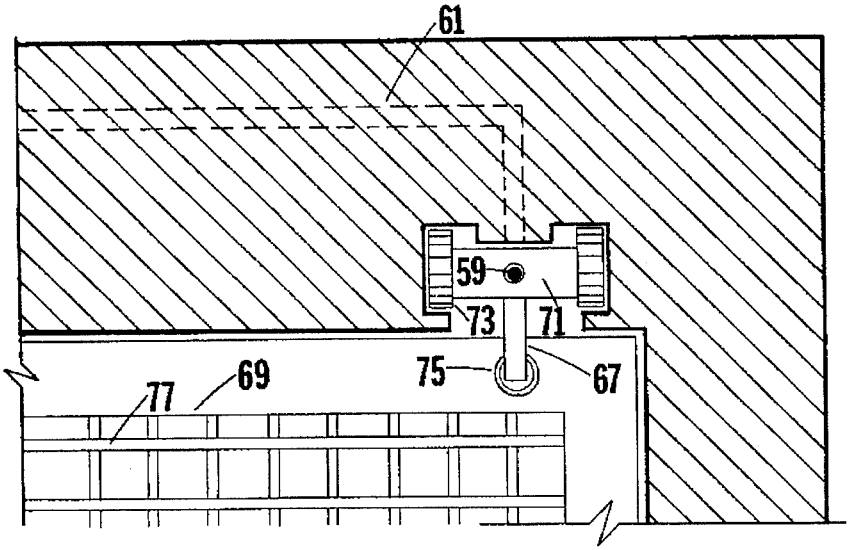
FIG. 4 shows a partial exploded plan of the wheel and track and mat of the present invention.

The mat 53 generally includes a netted interior 77 surrounded by a border 69 on which is disposed a plurality of securing loops 75 (FIG. 4). The mat 53 is positioned parallel to the pool bottom 45, and is held in placed by a vertical traversing wheel 63 which travels in a wheel track 55 (FIG. 3). The wheel 63 is secured to the mat 53 by a plurality of hook 67 connections (FIG. 2).

Figure 2:
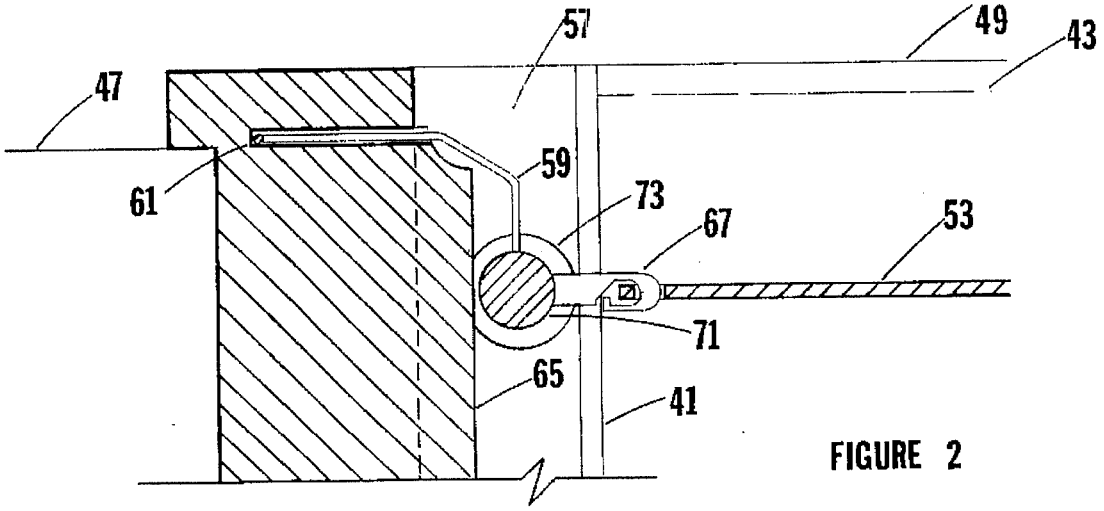
FIG. 2 shows an upper side section of the wheel and track, and cable connection to the mat of the present invention.

In FIG. 2 the wheel 63 is composed of a smaller stationary wheel 71 and a larger rotating wheel 73. The hook connector 67 is secured to a stationary wheel 71 portion of the wheel 63. Also attached to the topmost face of the stationary wheel 71 is a hoisting cable 59. The hoisting cable 59 runs through a cable conduit 61 which in turn engages the hoist (not shown) positioned inside a hoist housing 51.

Operation

In FIG. 3 the rescue mat is shown moving toward the pool surface 49. Inside the hoist housing 51 the hoist receives a pair of cables 59 from the cable conduit 61 lifting the rescue mat 53 from the pool bottom 45.

The wheel 63, connected to the cable 59, moves vertically up the track 55 via a wheel guide 65. When the mat 53 reaches the pool surface 49, the hoist ceases operation as the stationary wheel 71 reaches the top of the interior track wall 57 and the wheel guide 65. The wheel 63 tilts 90 degrees and rests at the top of the wheel guide 65. The cable 59 is taut, and the mat 53 is above the water's surface 43 and secured as the rescues is retrieved from the netted interior 77 of the mat 53.

Scope

Although the description above contains specificities, these should not be construed as limiting the scope of the invention but as merely providing illustrations of some presently preferred embodiments of this invention.

Thus the scope of the invention should be determined by the appended claims and their legal equivalents.

I claim:

1. A mat device for rescuing an individual from a swimming pool, comprising:

a horizontally disposed framework defined by an elongated border with a netted interior and circular looped holes disposed on the ends of the narrow side of said framework;

a plurality of hooked connectors for reception in each of said looped holes of said border of said framework;

a plurality of dual component wheels consisting of a smaller stationary wheel and a larger rotating wheel wherein each said connector is attached perpendicularly to each said stationary wheel;

a plurality of cables attachable to the topmost portion of each said stationary wheel;

a plurality of recessed tracks, disposed perpendicular to said narrow end of said framework, wherein said component wheels move vertically in said track, and dis posed generally near the top of said recessed track is a conduit in which said cable extends.

2. The mat device of claim 1 wherein said means for lifting is a hoist.

3. The mat device of claim 1 wherein all components of said mat device are constructed of plastic type materials and are water resistant.

* * * * *